US008931753B2

(12) United States Patent
Sollars

(10) Patent No.: US 8,931,753 B2
(45) Date of Patent: Jan. 13, 2015

(54) ADJUSTABLE FORM PANEL SYSTEM AND METHOD OF FORMING

(75) Inventor: Donald Sollars, Milpitas, CA (US)

(73) Assignee: Donald Sollars, Milpitas, CA (US)

( * ) Notice: Subject to any disclaimer, the term of this patent is extended or adjusted under 35 U.S.C. 154(b) by 311 days.

(21) Appl. No.: 13/146,396

(22) PCT Filed: Feb. 1, 2010

(86) PCT No.: PCT/US2010/022774

§ 371 (c)(1),
(2), (4) Date: Jul. 26, 2011

(87) PCT Pub. No.: WO2010/088627

PCT Pub. Date: Aug. 5, 2010

(65) Prior Publication Data

US 2011/0278432 A1 Nov. 17, 2011

Related U.S. Application Data

(60) Provisional application No. 61/148,856, filed on Jan. 30, 2009.

(51) Int. Cl.

| | |
|---|---|
| ***E04G 13/02*** | (2006.01) |
| ***E04G 11/02*** | (2006.01) |
| ***E04G 17/00*** | (2006.01) |

(52) U.S. Cl.

CPC ..... *E04G 11/02* (2013.01); *E04G 13/02* (2013.01); *E04G 17/00* (2013.01)

USPC ..... 249/194; 249/192

(58) Field of Classification Search

CPC ..... E04G 11/10

USPC ..... 249/13, 33, 40, 44, 47, 189, 192, 194; 52/238.1, 641, 645

See application file for complete search history.

(56) References Cited

U.S. PATENT DOCUMENTS

| | | | |
|---|---|---|---|
| 3,614,050 | A | 10/1971 | Greenhaigh |
| 4,535,577 | A | 8/1985 | Tenser et al. |
| 5,433,046 | A | 7/1995 | MacQuarrie et al. |
| 5,456,444 | A | 10/1995 | Wegman |
| 6,058,655 | A | 5/2000 | Gravel |

OTHER PUBLICATIONS

International Search Report and Written Opinion for PCT/US10/22774, mailed on Mar. 23, 2010.

*Primary Examiner* — Michael Safavi

(74) *Attorney, Agent, or Firm* — Schwabe Williamson & Wyatt PC

(57) ABSTRACT

A system for constructing a form for forming a concrete structure is disclosed herein. The system may include a number of extensible form panels. An extensible form panel may be constituted with a basis frame having a basis frame section and an extensible frame section extensible for a variable amount in at least one direction, along one axis. The frame sections may be configured to respectively accept and support basis and filler facings. The extensible frame section may include male/female endings. The system may also include a capping member with male and/or female endings. A form panel may include hinges, which may be swivelable, drive screws, and/or electronic motors. The system may further include a stub free to facilitate vertical coupling of form panels. In various embodiments, the parts may be formed with reusable material or materials.

27 Claims, 7 Drawing Sheets

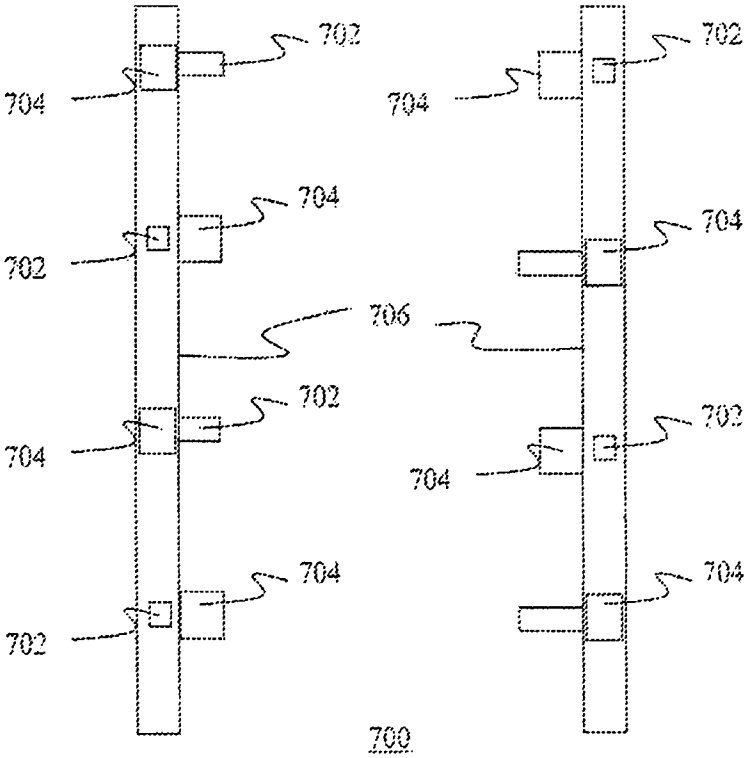
Figure 7b
Figure 7a
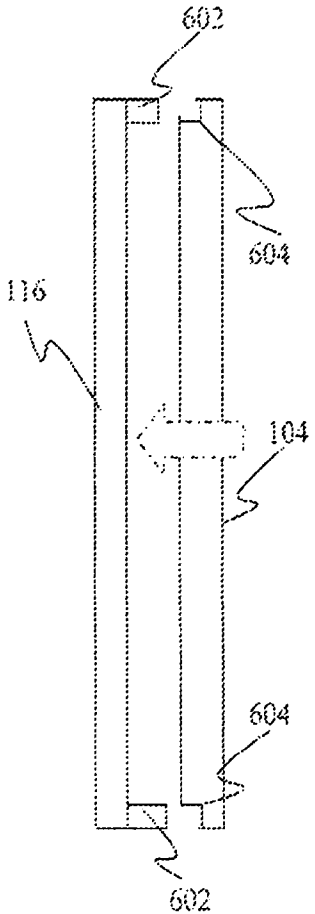
Figure 6

ADJUSTABLE FORM PANEL SYSTEM AND METHOD OF FORMING

RELATED APPLICATION

This Patent Cooperation Treaty (PCT) application claims priority to U.S. provisional application No. 61/148,856, entitled "Adjustable and/or Reusable Form Panels," filed Jan. 30, 2009. For U.S. National Stage, the specification of the provisional application is hereby incorporated by reference, to the extent it is consistent with this specification.

TECHNICAL FIELD

Embodiments relate to the field of construction, in particular, to a form panel system for constructing one or more forms for forming one or more concrete structures.

BACKGROUND

Concrete structures, such as basements, are typically formed by defining cavities corresponding to the concrete structures, pouring concrete in liquid form into the cavities, allowing the concrete to solidify, and after formation, dismantling the form. Each cavity defining form typically involves inner and outer form walls, formed using e.g. sheets of plywood. The inner and outer forms are typically supported by a number of brace and kicker combinations, with the braces jointly supporting the inner and outer forms, and the kickers correspondingly supporting the braces. Further, adjacent ones of the inner and outer forms are typically tied to ensure they are able to resist the large pressure of the liquid concrete wanting to expand the forms radially outward.

Wood stakes cut into appropriate lengths are typically used for braces and kickers. The braces are typically hammered into the ground, and the inner/outer forms are nailed to the braces; similarly, the kickers are driven into the ground and nailed to the braces. A large number of brace and kicker combinations are often required to provide the necessary strength to sustain the form and keep the liquid concrete in place, while the concrete solidifies over time. A variety of mechanisms including wires, bolts, and specialized hardware are used for ties. After the concrete has solidified and the structures have formed, the wooden brace and kicker combinations are removed, and the form is dismantled.

BRIEF DESCRIPTION OF THE DRAWINGS

Embodiments will be readily understood by the following detailed description in conjunction with the accompanying drawings. Embodiments are illustrated by way of example and not by way of limitation in the figures of the accompanying drawings.

FIG. 6 illustrates a side view of the basis frame and the filler facing, showing selected elements of the basis frame and the filler facing, showing selected elements of these other variants; and FIGS. 7*a*-7*b* illustrate front and side views of a stub tree, showing selected elements of these other variants, with all of the foregoing arranged in according with embodiments of the present disclosure.

DETAILED DESCRIPTION OF EMBODIMENTS

Figure 1:
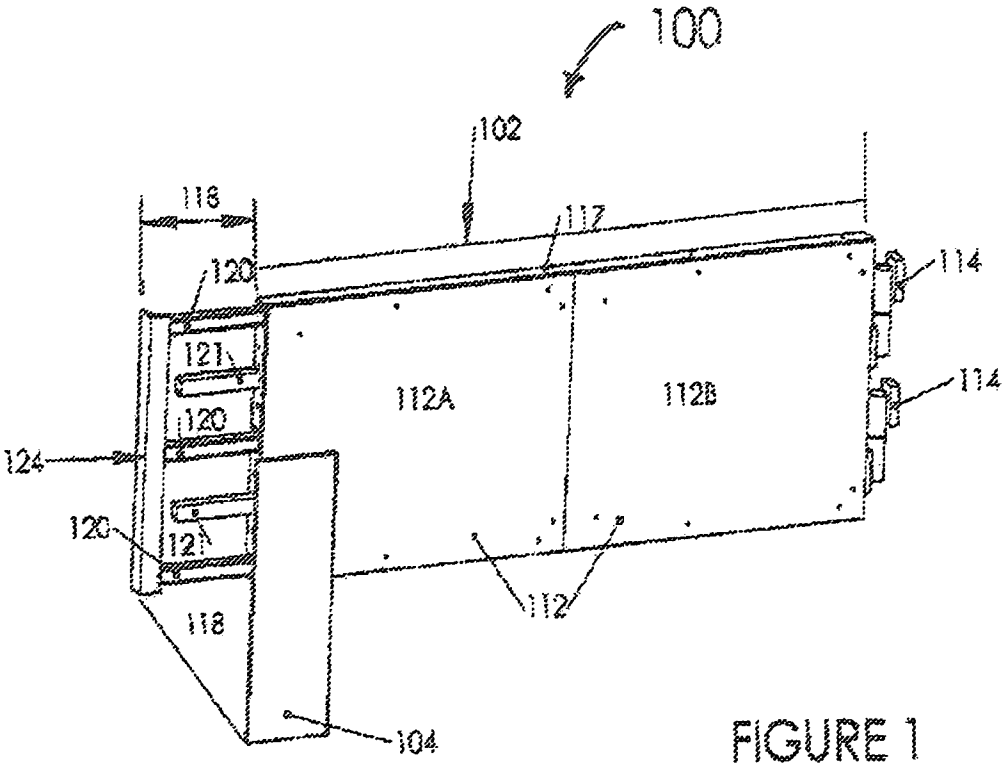
FIG. 1 illustrates a front perspective view of an extensible and/or reusable form panel of a form system in an extended position, showing selected elements of the form panel.

A system for constructing a form for forming a concrete structure is disclosed herein. The system may include a number of adjustable and/or reusable form panels, a number of which or all may be extensible to provide form panels of various desired dimensions. Various number of the extensible form panels, unextended/extended for varying amounts, and/or inextensible form panels may be removably, adjustably and flexibly coupled together to form a form of a selected number of shapes of selected dimensions (length, width, and/or height).

In various embodiments, an extensible form panel may be constituted with a basis frame having a basis frame section and an extensible basis frame section, one or more basis facings, and if extended, one or more filler facings. In various embodiments, the basis frame may be extensible for a variable amount in at least one direction, along at least one axis. In various embodiments, the unextended basis frame section may be configured to accept one or more basis facings. In various embodiments, the extended frame section may be configured to accept one or more capping members, and/or one or more filler facings of various dimensions totaling to correspond to the dimension of extension.

In various embodiments, the extensible frame section may be provided by a number of extendible/retractable tubes having male or female endings, configured to tightly mate with complementary female/male tubes of another form panel to enable the two form panels to be coupled together to jointly define a form or contribute in defining the form. In various embodiments, a capping member having different length male/female coupling may be employed to provide an angled edge. In various embodiments, at least some of the frames may be configured to be coupled with other frames in a non-coplanar manner. In various embodiments, such frame may include hinges or angled male/female couplings disposed on a side edge of the frame, which may be extensible or inextensible, and configured to mate with complementary hinges or angled male/female couplings of another frame of another similar form panel, to enable the two form panels to be coupled together to jointly define a form or contribute in defining the form, in a non-coplanar manner. In various embodiments, the parts of the form system of the present disclosure may be constituted with reusable material or materials.

Thus, in various embodiments, a reusable composite form panel, having the same interface specification as a single panel, may be configured using multiple, coupled, extensible basis frames, some or all of which may be extended, multiple basis facings and one or more filler facings, that comprise the difference between the combined length/area of the extensible basis frames and the combined length/area of the basis facings.

In the following detailed description, reference is made to the accompanying drawings which form a part hereof, and in which are shown by way of illustration embodiments in which the invention may be practiced. It is to be understood that other embodiments may be utilized and structural or logical changes may be made without departing from the scope of the disclosure. Therefore, the following detailed description is not to be taken in a limiting sense, and the scope of embodiments is defined by the appended claims and their equivalents.

Various embodiments will be described with references to the side views and/or top views of various components. The various views are to facilitate understanding, and are not limiting on the invention. The terms "substantially," "considerably," "significantly," "largely," may be used, and these terms are intended to be synonyms for each other. The description may use the phrases "in an embodiment," or "in embodiments," which may each refer to one or more of the same or different embodiments. Furthermore, the terms "comprising," "including," "having," and the like, as used with respect to embodiments, are synonymous.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other. For the purpose of this application, wood is not an reusable material for a component or a part, if the component or part is expected to touch concrete in liquid form, as the component or part will be stuck and not removable for reuse after the concrete solidifies.

Various operations may be described as multiple discrete operations in turn, in a manner that may be helpful in understanding embodiments; however, the order of description should not be construed to imply that these operations are order dependent. Also, embodiments may have fewer operations than described. A description of multiple discrete operations should not be construed to imply that all operations are necessary. Also, embodiments may have fewer operations than described. A description of multiple discrete operations should not be construed to imply that all operations are necessary.

For the purposes of the description, a phrase in the form "A/B" means A or B. For the purposes of the description, a phrase in the form "A and/or B" means "(A), (B), or (A and B)". For the purposes of the description, a phrase in the form "at least one of A, B, and C" means "(A), (B), (C), (A and B), (A and C), (B and C), or (A, B and C)". For the purposes of the description, a phrase in the form "(A)B" means "(B) or (AB)" that is, A is an optional element.

Referring now to FIG. 1, wherein a front perspective view of an extensible and/or reusable form panel of a form system in an extended position, showing selected elements of the panels, in accordance with various embodiments, is shown. Embodiments of the form system 100 of the present disclosure may include a plurality of the extensible and/or reusable form panels 102 (one shown), and optionally one or more inextensible form panels (none shown). As will be understood from the description to follow, a number of the extensible and/or reusable form panels 102 and optionally, non-extensible/non-reusable form panels, may be joined together to construct a form for forming a concrete structure, e.g. a basement, a retaining wall or even an entire building. The number of extensible form panels 102 and/or non-extensible/non-reusable form panels, if any, employed depend on the dimensions of the extensible form panels 102 and non-extensible form panels, and the dimensions of the concrete structure desired. The shape of the form constructed may be one of a plurality of shapes, to be described more fully below.

Figure 2:
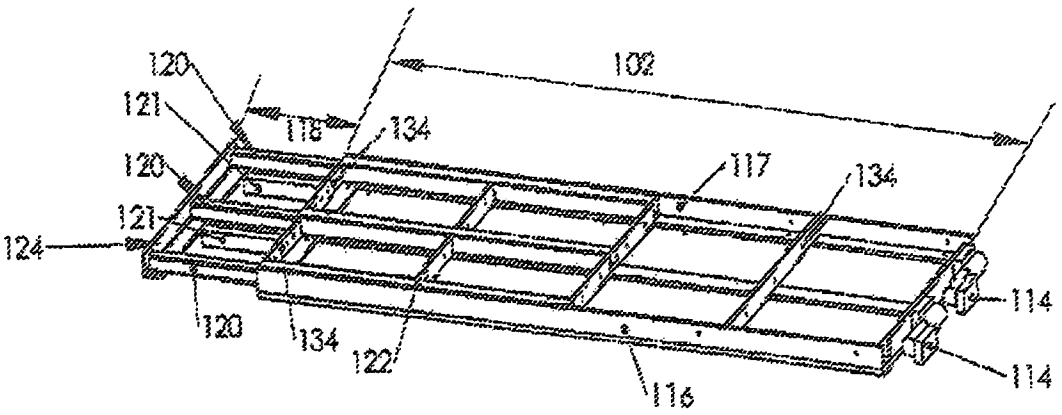
FIG. 2 illustrates a back perspective view of the extensible and/or reusable form panel of FIG. 1, showing selected elements of the form panel.

Referring now also to FIG. 2, wherein a back perspective view of the extensible and/or reusable form panel of FIG. 1, showing selected elements of the form panel, in accordance with various embodiments, is shown. In various embodiments, each extensible and/or reusable form panel 102 (hereinafter, simply form panel) may include an extensible basis frame 116 (hereinafter, simply frame) having a basis frame section and an extensible frame section extensibly coupled to each other. The basis/unextended section of basis frame may include a number of structural support 117 configured to accept and provide support to one or more pieces of basis facing 112 (two shown) that are typically standard sizes, however the basis facing 112 may be of different sizes. As will be described in more detail later, basis facing 112 and filler facing 104, although coupled to basis frame 116 and extensible frame section 118, are structurally independent and are not required to maintain a fixed relationship. The extensible frame section 118 may be configured to accept, when extended, one or more pieces of filler facing 104, that when combined with basis facing 112*a*, 112*b*, etc. (basis facing can extend into the extended section), provide a total dimension to correspond to the overall dimension of form panel 102, including basis frame plus extension. The filler facings 104 may likewise be of the same size or different sizes. One of the advantage provided by basis frame 116 configured to accept and support basis and/or filler facings 112 and 104 of different sizes is to enable potentially different geometric, e.g., line patterns or textures to be imparted on the surfaces of the resulting concrete structure.

In various embodiments, extensible basis frame 116 may be constituted with wood beams, metal frames, plastic pipe, metal rods, metal tubing, and/or other parts of the like. In various embodiments, basis facing 112 and filler facing 104 may be coupled to frame 116 using e.g. bolts and nuts, screws, nails and so forth. In various embodiments, facing 112 and/or 104 may be coupled to frame 116 magnetically, to provide an additional degree of freedom to facing 112 and/or 104, relative to basis frame 116.

In various embodiments, as described earlier, basis frame 116 may be extensible in at least one direction (one shown) along at least one axis (one shown), and may comprise extension section 118. In various embodiments, basis frame 116 may include a number of openings 134 to facilitate, via the employment of a coupling member (not shown), holding the extended section 118 in place.

Figure 3:
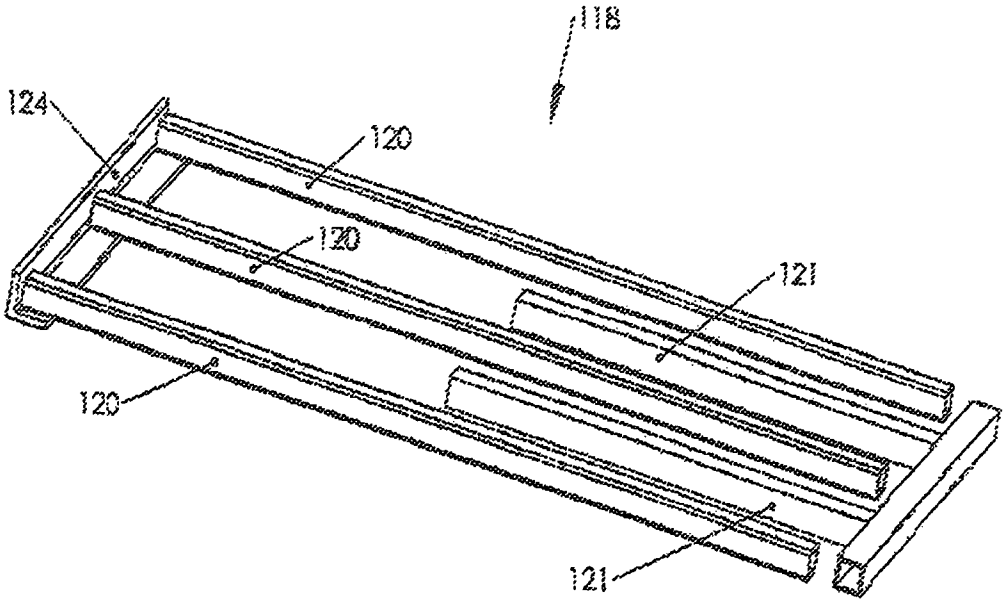
FIG. 3 illustrates an exploded perspective view of a basic extensible frame section of FIGS. 1 and 2, showing selected elements of the extensible frame section.
Figure 5B:
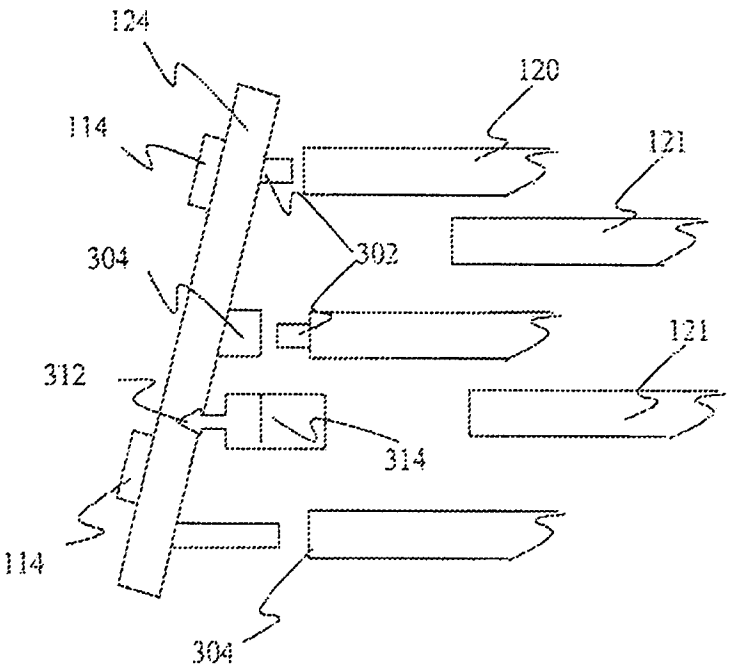
FIGS. 5*a*-5*b* illustrate front views of other variants of the extensible frame section, showing selected elements of these other variants.
Figure 5A:
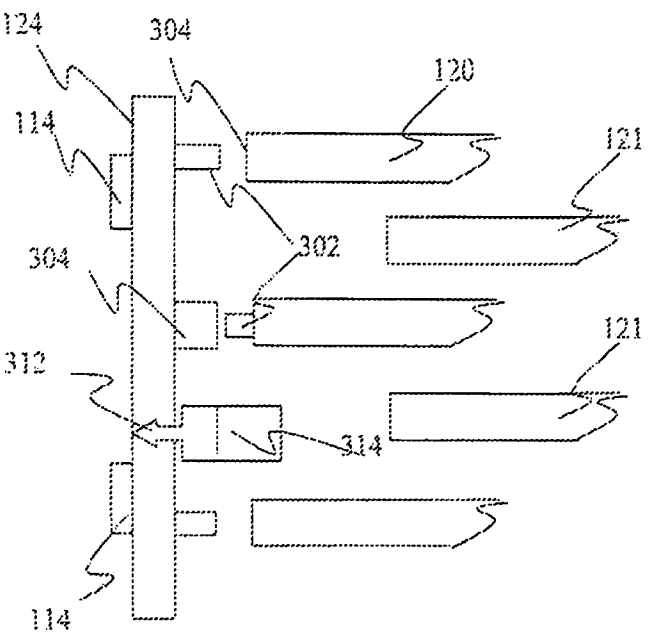

Referring now also to FIGS. 3 and 5*a*-5*b*, wherein isolated exploded perspective views of extension section 118, showing selected elements of the extension section and complementary capping members, in accordance with various embodiments, are illustrated. Extension section 118 may include a number of horizontal members 120 and optionally, horizontal members 121. Horizontal members 120 may have male or female ends 302 or 304 configured to tightly mate with complementary female or male ends 304 or 302 of corresponding horizontal members of another frame to facilitate joining the frames together, or jointly capped with e.g. complementary vertical member 124 having complementary male/female ends 302/304, when not joined with another frame. In alternate members, when not joined with another frame, each horizontal member 120 may be individually capped instead. Horizontal members 120, in addition to being configured to mate with corresponding members of another form panel or capping members, may also be configured to provide support to filler facing 104. In various embodiments, horizontal members 121 may be configured to provide supplemental support to filler facing 104.

For the embodiments, horizontal members 120 may be correspondingly and telescopically nested inside a number of corresponding horizontal members 117. Thus, section 118 of frame 116, may be fully retracted, providing zero additional extension length to form panel 102, or it might be fully or partially extended to provide a desired additional amount of extension length to form panel 102. In this manner, extensible form panels 102 (in conjunction with zero or more inextensible form panels) may be tightly coupled together to construct a form of virtually any variable linear dimension, not necessarily an integer multiple of the length of the form panels. As will be described in more detail below, extended form panel 102 may be of any vertical dimension, not necessarily an integer multiple of the height of the form panels either. In various embodiments, each of members 120 may include features (not shown) to facilitate acceptance and provision of support for one or more filler facings 104 to the extension section 118, using e.g. bolts and nuts, screws, nails and so forth. In various embodiments, similar to basis facing 112, filler facing 104 may likewise be coupled to frame 116 magnetically, using magnets.

In general, the extensible frame section 118 is smaller than basis/inextensible frame section. Their respective exact sizes, the number and dimensions of structural support 117, the number and dimensions of members 120 and 121, the number and dimensions of basis and filler facings 112 and 104 are application dependent, depending on the size and/or dimensions of form panel 102, and the amount of liquid concrete supported desired.

Referring now to FIG. 5*a* in particular, capping member 124 may include one or more driving screws 312 to secure adjacent joined frames, and to provide fine grain adjustments to enable two adjacent joined frames be more precisely and/or tightly joined together to provide a desired dimension, and then held in place at that dimension. In various embodiments, driving screw 312 may include a gear reduction drive or a transmission to provide the necessary torque to strip the forms after the concrete has been poured. In various embodiments, driving screw 312 may be driven by air or hydraulic power. In various embodiments, capping member 124 may also be provided with electronic motors 314 to respectively drive driving screws 312. In alternate embodiment, a detachable (relocatable) electronic motor 314 may be provided instead. In various embodiments, electronic motors 314 may be a servo or a step motor (with transmissions, in some embodiments) equipped to drive forward or reverse, enabling electronic motors 314 to introduce vibration to the concrete being poured by rapidly and alternatingly operating the electronic motors 314 in a forward and a reverse mode. In various embodiments, electronic motor 314 may include a communication interface, e.g. a wireless communication interface, and a controller coupled to each other, to enable electronic motor 314 to be controlled by a computing device (not shown). In various embodiments, the communication interface and/or the controller and/or the basis frame and/or the extension section may be provided with Global Positioning System (GPS) capability such that the form panel 102 is able to provide its location to a computing device by way of its communication interface.

In various embodiments, the driving screws 312, with or without electronic motors 314 (with or without a gear reduction drive, transmission, communication interface or controller) may be similarly provided to an inextensible edge of basis frame 116.

Referring now to FIG. 5*b*, in particular, capping member 124 may have complementary male and/or female coupling features of different lengths to enable an angular edge be formed, suitable for contributing to constituting a form with a slanted or angled surface, such as an angled roof of a building. In various embodiments, form system 100 may include capping members 124 with complementary male and/or female coupling features of different lengths to enable edges of different angles be formed.

In alternate embodiments, frame 116 may be extensible in both sides and/or in the mid-section. Note that a frame extensible in mid-section may be considered functional equivalent to a frame extensible on both sides. For the extensible mid-section embodiments, the side edges may comprise either the earlier described male or female endings. Additionally, the side edges may also comprise the earlier described drive screws and/or electronic motors. In various embodiments, regardless whether frame 116 is extensible in one side, in both sides, or in mid-section, each of the extension sections 118 may include multiple telescopic sections. For embodiments with extension section 118 telescoping retractable into frame 116, and extend there from, filler facings of different thickness and/or spacers may be employed to ensure the surfaces of filler facings 104 and facings 112 are flushed.

In alternate embodiments, frame 116 may be extensible in both sides and/or in the mid-section not only along one axis as illustrated, but extensible in one or both sides and/or in the mid-section along another axis orthogonal to the axis with illustrated extension, additionally or instead. Likewise, the extension section may have male and/or female endings, and/or collectively or individually capped, as earlier described.

In various embodiments, frame 116 includes other openings (not shown) to facilitate wood pieces to be inserted to act as nailers for coupling a brace to support the form panel. In alternate embodiments, other arrangements may be employed to couple a brace and kicker to support form panel 102.

Still referring to FIGS. 1-3 and 5*a*-5*b*, in various embodiments, form panel 102 as described earlier may include a number of hinges 114 disposed at one or both edges of frame 116, and configured to mate with complementary hinges of another frame of another form panel, to facilitate coupling the two form panels together. In various embodiments, the hinges may be swivelable, allowing two adjacent form panels to be formed in a non-coplanar manner, that is, the interior angle defined is less than 180 degrees, while the exterior angle defined is greater than 180 degrees. In various embodiments, hinges 114 may be provided to capping members 124 to enable non-coplanar coupling of two form panels at the extensible side.

Figure 5D:
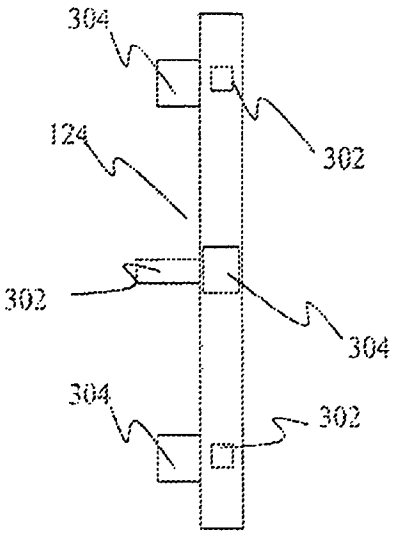
FIGS. 5*c*-5*d* illustrate front and side views of other variants of the capping member, showing selected elements of these other variants.
Figure 5C:
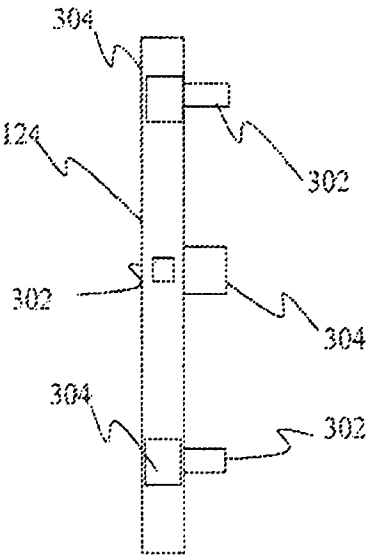

Referring now to FIGS. 5*c*-5*d*, wherein a front and side view other variants of capping members 124, showing selected elements of these other variants, in accordance with embodiments of the present disclosure. As illustrated, in various elements, capping members 124 may be provided with male and/or female coupling members 302 and 304 on at least two sides of capping members 124 to facilitate 90° coupling of two form panels 102, in lieu of using hinges 314. Such variants may also be provided with drive screws and electronic motors as earlier described (although not shown). In various embodiments, male and/or female couplings 302 and 304 may be angularly disposed as opposed to perpendicular to the surface of capping member 124 to provide other angular coupling of two form panels 102.

Referring in particular to FIG. 1, once extended, one or more filler facings 104 providing total dimension corresponding to the dimension of extension may be joined to section 118 to lengthen or heighten the section of the inner or outer form. As described earlier, the filler facings might have appropriate thickness, or spacer may be employed to ensure the surfaces of filler facings 104 and basis facings 112 are flushed. Thus, the filler facings of the system, if included, may be of various dimensions and thickness configured for different amount of extensions and telescoping. If not included, any plywood, plastic or other like material cut to the desired dimension, having appropriate thickness (with or without the assistance of spacers) may be employed as a filler facing. Even for these embodiments, by virtue of the form panels being reusable, there are still substantial reductions in wood waste.

Filler facing 104 and section 118 may be endowed with complementary features, such as openings, to allow them to be joined together, as described earlier, using e.g. nuts and bolts, or screws. Alternatively, in some embodiments, section 118 may be made of wood, allowing filler facing 104 to be nailed to section 118. Still in other embodiments, filler facing 104 may be coupled to section 118 magnetically, using magnets. Referring now also to FIG. 6, wherein a side view of a frame 116 and a filler facing 104, showing selected elements of the frame and facing, in accordance with various embodiments, is shown. As illustrated, in various embodiments, frame 116 may include top and bottom flanges 602, while filler facing 104 may include complementary steps 604 to enable filler facing 104 to be tightly coupled in place with frame 116, when they are joined together (as depicted by the dotted arrow). In various embodiments, basis facing 112 may likewise be provided with similar steps and coupled with frame 116 in like manner. Those with ordinary skill would appreciate that basis facing 112 and filler facing 104, although coupled with frame 116 and/or extension 118, can move along the axis of the form panel, relative to frame 116, and vice versa, without changing the distance between the inner and outer forms.

In various embodiments, the parts described above may be made of reusable materials, e.g. metal. In various embodiments, the parts may be welded together. In alternate embodiments, some parts may be fastened together using nuts and bolts, or nails. From the foregoing description, those of ordinary skill would appreciate that an extended form panel 102 (having been provided with appropriate filler facing(s)) appears just like an unextended form panel 102 with the greater extended dimension. In various embodiments, a reusable composite form panel, having the same interface specification as a single panel, may be configured using multiple, coupled, extensible basis frames, some or all of which may be extended, multiple basis facings and one or more filler facings, that comprise the difference between the combined length/area of the extensible basis frames and the combined length/area of the basis facings.

Figure 4A:
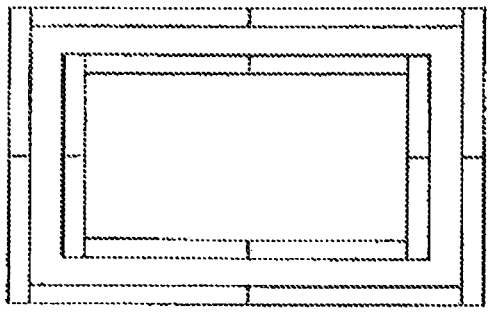
FIGS. 4*a*-4*c* illustrate example shapes of different forms can be constructed using the form system with the form panels of FIGS. 1 and 2.
Figure 4B:
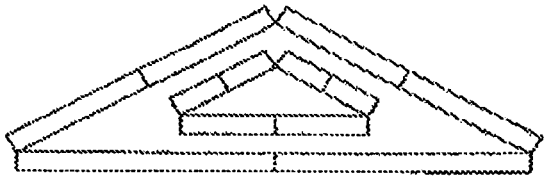
Figure 4C:
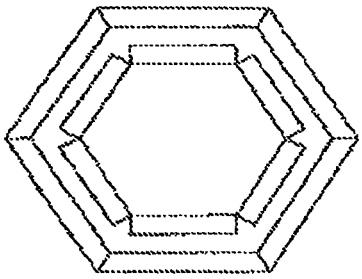

FIGS. 4*a*-4*c* illustrate a number of example forms of different shapes may be formed using the form panels of the form system of the present disclosure. FIG. 4*a* illustrates a shape that is substantially rectangular. FIG. 4*b* illustrates a shape that is substantially triangular, whereas FIG. 4*c* illustrates a shape having a substantially hexagon. The various example shapes are merely illustrative, and not limiting on the present disclosure.

In various embodiments, as described earlier, form panels 102 may not only be joined together linearly in a planar or non-coplanar manner to form forms of various shapes as described, form panels 102, in particular, employing embodiments that are extensible vertically, may be joined together vertical to form forms of various heights. To facilitate coupling of form panels 102 vertically, a stub tree 700 as illustrated in FIG. 7, showing selected features of the stub tree 700, in accordance with various embodiments, may be employed. For the embodiments, stub tree 700 may comprise a longitudinal body 706 having male and/or female couplings 702 and 704 disposed on at least one side surfaces of body 706, spaced apart from each other in any one of a number of configurations (one substantially equal distance configuration shown.) Embodiments with male and/or female couplings 702 and 704 disposed on at least two side surfaces of body 706 may be particularly suitable for coupling form panels 102 vertically at a corner of a form being formed, while if male and/or female couplings 702 and 704 were disposed on opposing sides of body 706, multiple form panels 102 could be coupled linearly.

From the foregoing description, those of ordinary skill in the art will appreciate that the various features of the form panel apparatus of the present disclosure enables a form of a selected one of a number of shapes and/or dimensions (length, width, height) for forming various concrete structures from a basement, to a retaining wall, or even an entire building, to be formed efficiently, resulting in substantial saving in labor. The form panels may be tightly coupled together. When used in conjunction with e.g. the brace, kicker and tie apparatus of co-pending application, attorney docket reference 115954-168286, entitled "Adjustable and/or Reusable Brace, Kicker and Tie Method and Apparatus," contemporaneously filed, the form panels may be tightly coupled together supported by the brace, kicker and tie apparatus of the co-pending application, with minimal or even without ties to tie the form panels together. Equally significant, after the desired concrete structure has been formed, the form apparatuses can be disassembled relatively easily. Accordingly, the apparatuses may be reused to construct another form of similar or different shape and/or dimensions for forming another concrete structure of similar or different shape and/or dimensions.

Thus, embodiments of an adjustable and/or reusable form apparatus have been described. Although certain embodiments have been illustrated and described herein for purposes of description of the preferred embodiment, it will be appreciated by those of ordinary skill in the art that a wide variety of alternate and/or equivalent embodiments or implementations calculated to achieve the same purposes may be substituted for the embodiments shown and described without departing from the scope of the disclosure. Those with skill in the art will readily appreciate that embodiments of the disclosure may be implemented in a very wide variety of ways. This application is intended to cover any adaptations or variations of the embodiments discussed herein. Therefore, it is manifestly intended that embodiments of the disclosure be limited only by the claims and the equivalents thereof.

What is claimed is:

1. An apparatus for forming a concrete structure, comprising:

a basis frame section configured to accept and support one or more basis facings; and an extensible frame section extensibly coupled with the basis frame section at an edge of the basis frame section to form an extensible frame, and configured to accept and support one or more filler facings, when the extensible frame section is extended, partially or fully;

wherein the basic frame section and the extensible frame section combines to form an extensible form panel for contributing to form a form for forming the concrete structure;

wherein the apparatus further comprises:

a drive screw configured to facilitate joining and disjoining the apparatus with another like apparatus, including being configured to provide fine grain adjustments to join the two apparatuses, and being configured to provide sufficient torque to disjoin the two apparatuses after the concrete structure has been formed; and an electronic servo or step motor configured to drive the drive screw, including alternating driving the drive screw in a forward mode and a reverse mode to introduce vibration to concrete being poured into the form to form the concrete structure.

2. The apparatus of claim 1, wherein the basis frame section comprises a first plurality of support members, and the extensible frame section comprises a second plurality of support members correspondingly and extensibly coupled with the first support members.

3. The apparatus of claim 2, wherein the extensible frame section further comprises a third plurality of support members not coupled with the first plurality of support members, and configured to accept and support the one or more filler facings.

4. The apparatus of claim 2, wherein the first and second support members are correspondingly and telescopically nested within each other.

5. The apparatus of claim 2, wherein the second plurality of support members comprises male or female endings configured to mate with complementary female or male endings of another basis or extensible frame section of another extensible frame, or one or more capping member.

6. The apparatus of claim 5 further comprising a capping member having a male or female coupling member, and the drive screw.

7. The apparatus of claim 6, wherein the capping member further comprises the electronic servo or step motor, and a wireless communication interface configured to facilitate wireless control of the electronic servo or step motor to alternating driving the drive screw in the forward and reverse modes to introduce vibration to concrete being poured into a form comprising the apparatus.

8. The apparatus of claim 5, further comprising a capping member having a male or female coupling member disposed at one surface, and a hinge disposed at another surface, configured to mate with complementary hinges of another like capping member or another like apparatus.

9. The apparatus of claim 5 further comprising a capping member having a plurality of male or female coupling members disposed on a plurality of adjacent surfaces of the capping member.

10. The apparatus of claim 1, wherein the drive screw is disposed at an edge of the basis frame section, and comprises a gear reduction or transmission to provide the sufficient torque to disjoin the two apparatuses after the concrete structure has been formed.

11. The apparatus of claim 10, further comprising the electronic servo or step motor, and a wireless communication interface configured to facilitate wireless control of the electronic servo or step motor to alternating driving the drive screw in the forward and reverse modes to introduce vibration to concrete being poured into a form comprising the apparatus.

12. The apparatus of claim 1, further comprising a hinge disposed at one edge of the basis frame section, and configured to mate with a complementary hinge of another like apparatus.

13. The apparatus of claim 1, further comprising another extensible frame section extensibly coupled with the basis frame section at another edge of the basis frame section, and configured to accept and support another one or more filler facings, when the another extensible frame section is extended, partially or fully.

14. The apparatus of claim 1 further comprising a basis facing and/or a filler facing.

15. The apparatus of claim 1, wherein the basis and extensible frame sections are made of material or materials designed to enable the apparatus to be reusable in forming another form to form another concrete structure.

16. A system for forming a concrete structure, comprising:

a first extensible form panel having a first dimension unextended and extensible to provide a selected one of a second dimension; and a second extensible or inextensible form panel;

wherein the first and the second form panels are configured with complementary features to facilitate removable coupling of the first and second form panels to jointly constitute or contribute in constituting one or more inner or outer form walls of a form for forming a concrete structure;

wherein the system further comprises:

a drive screw, including a gear reduction drive or transmission, to facilitate joining and disjoining the first and second form panels, including providing fine grain adjustments to joining the two form panels, and providing sufficient torque to disjoining the two form panels after the concrete structure has been formed; and an electronic motor configured to drive the drive screw, including alternating driving the drive screw in a forward mode and a reverse mode to introduce vibration to concrete being poured into the form to form the concrete structure.

17. The system of claim 16, wherein the first and second form panels comprise corresponding complementary hinges disposed at respective edges of the form panels to enable the form panels to be coupled together.

18. The system of claim 17, wherein the hinges are swivelable, enabling the two form panels to be coupled together in a non-planar manner.

19. The system of claim 16, wherein the first and second form panels comprise corresponding complementary male or female endings disposed at respective edges of the form panels to enable the form panels to be coupled together.

20. The system of claim 19, wherein the male or female endings of the first form panel are disposed on a capping member coupled with an extensible section of the first form panel.

21. The system of claim 16, wherein the drive screw is disposed at an edge of a selected one of the first or second form panels.

22. The system of claim 21, wherein the electronic motor comprises an electronic servo or step motor disposed on the same selected one of the first or second form panels.

23. The system of claim 19 further comprises a stub tree having a plurality of male or female endings configured to facilitate coupling of the first and second extensible form panels.

24. The system of claim 16, wherein the first extensible form panel comprises a basis frame having a basis frame section with the first dimension and an extensible frame section coupled with the basis frame section and extensible to provide the selected one of the second dimension.

25. The system of claim 24 further comprising a basis facing configured to be coupled with the basis frame section, and a filler facing configured to be coupled with the extensible frame section, when the extensible frame section is sufficiently extended to accept the filler facing.

26. The system of claim 16, wherein the first form panel is constituted with material or materials designed to enable the selected one form panels to be reusable.

27. An apparatus for forming a concrete structure, comprising:

first means for extensibly contributing in forming a section of an inner or outer form wall of a form for forming a concrete structure;

second means for extensibly contributing in forming the section of the inner or outer form wall;

third means for coupling the first and second means along an axis;

a drive screw, including a gear reduction drive or transmission, to facilitate joining and disjoining the first and second means, including providing fine grain adjustments to joining the two form panels, and providing torque to disjoining the two means after the concrete structure has been formed; and an electronic servo or step motor configured to drive the drive screw, including alternating driving the drive screw in a forward mode and a reverse mode to introduce vibration to concrete being poured into the form to form the concrete structure.

* * * * *